US010154746B2

(12) United States Patent
de Vries et al.

(10) Patent No.: US 10,154,746 B2
(45) Date of Patent: Dec. 18, 2018

(54) SERVING TRAY

(71) Applicant: Devan Surface B.V., Amsterdam (NL)

(72) Inventors: Tim Ewout de Vries, Amsterdam (NL); Jorrit Gerben Van Keulen, Ruurlo (NL)

(73) Assignee: DEVAN SURFACE B.V., Amsterdam (NL)

( * ) Notice: Subject to any disclaimer, the term of this patent is extended or adjusted under 35 U.S.C. 154(b) by 0 days.

(21) Appl. No.: 14/427,178

(22) PCT Filed: Aug. 26, 2013

(86) PCT No.: PCT/NL2013/050615
§ 371 (c)(1),
(2) Date: Mar. 10, 2015

(87) PCT Pub. No.: WO2014/042521
PCT Pub. Date: Mar. 20, 2014

(65) Prior Publication Data

US 2015/0305535 A1 Oct. 29, 2015

(30) Foreign Application Priority Data

Sep. 13, 2012 (NL) ..... 2009452

(51) Int. Cl.
*A47G 19/02* (2006.01)
*A47G 23/06* (2006.01)
(Continued)

(52) U.S. Cl.
CPC ..... *A47G 23/06* (2013.01); *A47G 23/0625* (2013.01)

(58) Field of Classification Search
CPC ... A47G 19/065; A47G 23/0625; A47J 47/14; B65D 1/34
(Continued)

(56) References Cited

U.S. PATENT DOCUMENTS 3,318,283 A 5/1967 Maclam
4,746,057 A 5/1988 Wagner
(Continued)

FOREIGN PATENT DOCUMENTS

CN 2266953 Y 11/1997
CN 201899289 U 7/2011
(Continued)

OTHER PUBLICATIONS

International Search Report and Written Opinion for corresponding foreign application PCT/NL2013/050615, filed Aug. 26, 2013.
(Continued)

*Primary Examiner* — Andrew T Kirsch
(74) *Attorney, Agent, or Firm* — Steven M. Koehler; Westman, Champlin & Koehler, P.A.

(57) ABSTRACT

A serving tray comprises a top side and a bottom side generally parallel to each other and a periphery. The top side is arranged for supporting objects on the tray and the bottom side for carrying the tray by hand. The tray has a center of gravity and an axis extending substantially perpendicular through it. The bottom side has a relief comprising first and second gripping structures each generally surrounding the axis, and being recessed and providing a first and second radially inner gripping surface, respectively, and being arranged such that sections of the first and second inner gripping surfaces are located diametrically opposite each other at first and second radial distances with respect to the axis, respectively, and such that in plural azimuthal positions around the axis the ratios of the first and second radial distances of the respective opposite sections are equal.

20 Claims, 6 Drawing Sheets

(51) Int. Cl.
*A47J 47/14* (2006.01)
*B65D 1/34* (2006.01)

(58) Field of Classification Search
USPC ..... 220/608
See application file for complete search history.

(56) References Cited

U.S. PATENT DOCUMENTS

| | | | | |
|---|---|---|---|---|
| 5,076,438 | A | 12/1991 | Aronson | |
| 5,797,495 | A | 8/1998 | Lerrick | |
| 6,145,906 | A | 11/2000 | Wright | |
| 6,691,890 | B1 * | 2/2004 | Persson | A47G 19/065 220/574 |
| 2007/0215512 | A1 | 9/2007 | Bellissimo | |

FOREIGN PATENT DOCUMENTS

| | | | |
|---|---|---|---|
| CN | 202262788 | U | 6/2012 |
| DE | 9201363 | | 4/1992 |
| GB | 432744 | A | 8/1935 |
| GB | 2367233 | A | 4/2002 |
| GB | 2478299 | | 9/2011 |
| JP | 200721091 | A | 8/2008 |

OTHER PUBLICATIONS

Chinese Office Action for corresponding Chinese patent application 201380048446.5, dated Jan. 26, 2016.
Second Chinese Office Action for Chinese patent application No. 2013800484465, dated Oct. 8, 2016.

* cited by examiner

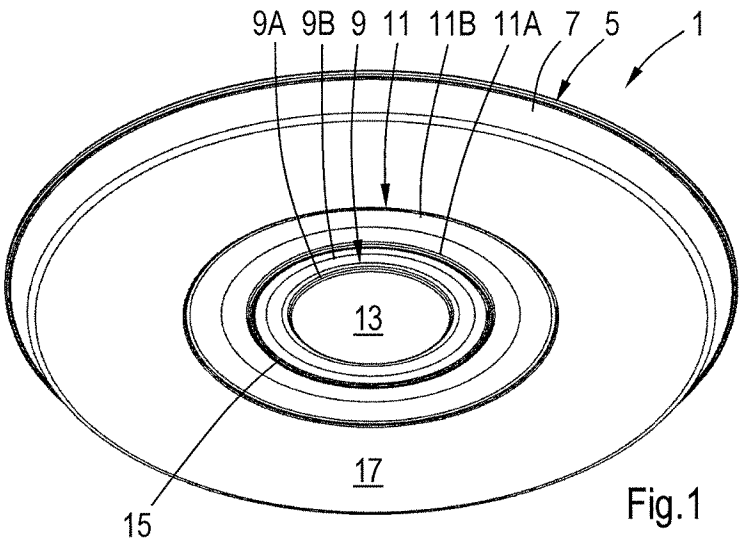
Fig.1
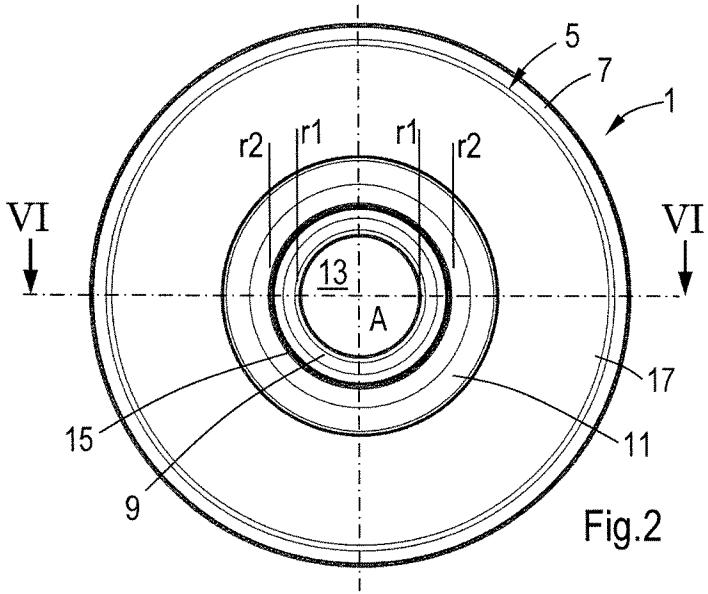
Fig.2
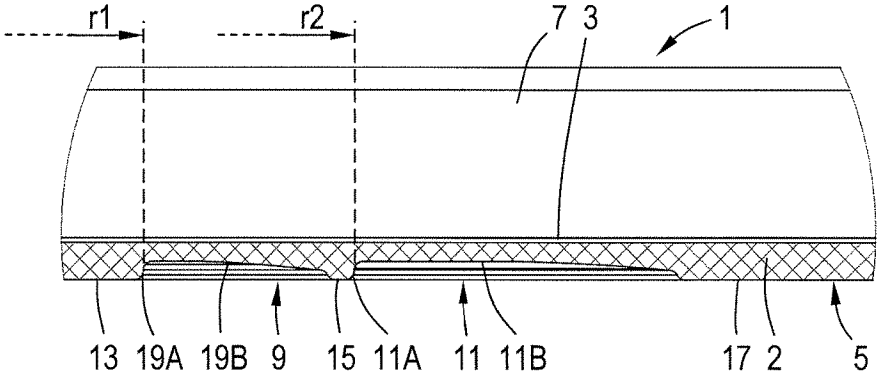
Fig.4
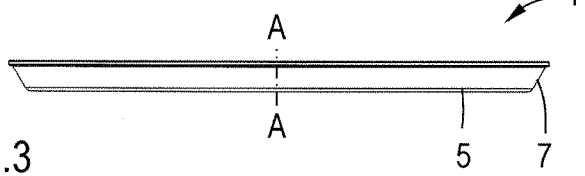
Fig.3
Fig.5

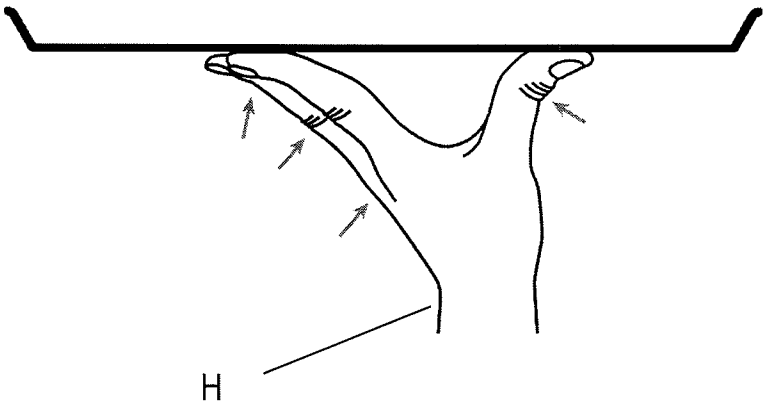
Fig. 11 – PRIOR ART
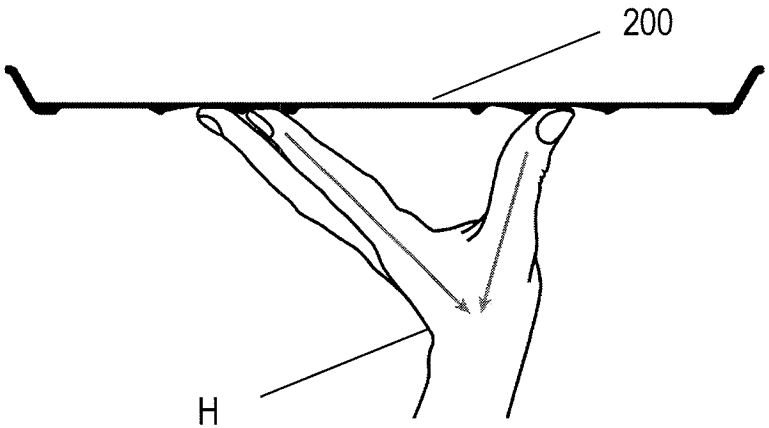
Fig. 12

SERVING TRAY

CROSS-REFERENCE TO RELATED APPLICATION

This application is a Section 371 National Stage Application of International Application PCT/NL2013/050615 filed Aug. 26, 2013 and published as WO 2014/042521 A1 in English.

TECHNICAL FIELD

The present disclosure relates to serving trays, in particular serving trays wherein the tray is carried on one hand of a user, e.g. a waiter or waitress, and food and/or drinks carried on the tray are served from the tray by the user with the other hand.

BACKGROUND

Serving trays of the aforementioned type are ubiquitous, and it is well known that their use critically depends on the ability of the user to balance the tray and in particular in a professional environment, on minimizing user muscle fatigue and spillage. To address this, several approaches have been presented in the art, but none are found satisfactory.

SUMMARY

Inter alia in view of the above, an improved tray is hereby provided, comprising a top side, a bottom side, and a periphery. The top and bottom sides are generally parallel to each other, the top side being arranged for supporting one or more objects on the tray and the bottom side being arranged for carrying the tray by hand. The tray has a centercenter of gravity and an axis extending through the center of gravity substantially perpendicular to the top and bottom sides. The bottom side has a relief providing first and second gripping structures each generally surrounding the axis, the first gripping structure being recessed into the tray and providing a first radially inner gripping surface, in particular for gripping with the thumb of one hand, and the second gripping structure being recessed into the tray and providing a second radially inner gripping surface, in particular for gripping with (the tips of) one or more of the other four fingers (index-, middle-, ring-, and little fingers) of the same hand. In the tray, the first and second gripping structures are arranged such that sections of the first and second inner gripping surfaces are located diametrically opposite each other at first and second radial distances with respect to the axis, respectively, and such that in plural azimuthal positions around the axis, the ratio of the first and second radial distances of the respective opposite sections are equal.

Thus, in one direction from the axis a first gripping surface section is arranged at a first radial position r1, and opposite from it, relative to the axis, a second gripping surface section is arranged at a second radial distance r2, wherein the ratio R of the first and second radial distances has a particular value (R=r1/r2). In a further direction from the axis, a further first gripping surface section is arranged at a respective further first radial position r1' and opposite from it, relative to the axis, a further second gripping surface section is arranged at a respective further second radial distance r2', and such that the ratio R' of the further first and second radial distances (R'=r'/r2') has the same value as before: R'=R, even if the first and further first radial distances r1, r1' and the second and further second radial distances r2, r2', respectively, differ.

In this way, the axis of the tray and therefore the center of gravity of the tray is at the same relative position between the first and second inner gripping surface sections. As a consequence, the tray is always balanced in the same way when gripped at the first and second inner gripping surface sections. Therefore, the tray can be easily and intuitively held and supported reliably by one hand with feeling, engaging and/or gripping the first and second inner gripping surface sections between the thumb and at least some of the other fingers on opposite sides of the axis.

If the ratio R is constant around the axis, the center of gravity and the balance of the tray is constant around the axis.

If the first and second inner gripping surfaces are substantially continuous around the axis, a reliable grip can be obtained independent of the rotational orientation of the tray around the axis.

If the first and second inner gripping surfaces, or the first and/or second gripping structures as a whole, are configured as concentric rings, the axis of the tray the effect of the tray, its use and/or benefits may be readily discernible.

In case of concentric circular rings, not only the ratio R but also the radial positions r1, r2, of the first and second gripping surfaces are constant so that an axially symmetric object is provided of which the gripping size and the balance with respect to the gripping features is identical in any rotational orientation around the axis.

If the top side is generally planar, objects can be placed stably on the tray at will.

If the bottom side is, apart from the recessed gripping structures, substantially planar, the tray can be placed stably on a flat table or counter top and/or can be slid from that smoothly and stably, e.g. onto the hand of a user.

If the bottom side comprises one or more further recessed portions, markings in print and/or relief, in particular being shallow with respect to the depth of the recessed portion(s), e.g. advertisement images, may be provided in the further recessed portions and be shielded against wear when placing and sliding the tray on or against a surface, e.g. a counter. Such recessed portion may conform generally to the shape of the gripping structures around the axis, e.g. be generally circular around the axis. Such further recessed portion(s) also help reducing weight of the tray. A relief may be formed as a marking in itself, e.g. an image and/or a text. A transparent cover over the recessed portion may be provided, further protecting any relief and/or print.

At least one of the first and second gripping structures may be asymmetric and have, in radial cross section, first and/or second inner gripping surfaces with a radially inner slope that is relatively steep and a top surface (bottom surface when seen from the bottom side) having a radially outer outward slope that is relatively small, with respect the radial direction resulting in a small angle relative to axial direction, e.g. parallel or nearly parallel to the axis and perpendicular to the bottom side. Thus, a reliable and firm inward grip on the tray is possible on the gripping surface(s), and the angle between the top surface of the gripping structure(s) and the direction of extension of the fingers gripping the respective gripping structure(s) is at a less acute angle than in case of a planar radially extending surface, which reduces the finger-spreading force on the hand encountered with a planar surface.

At least part of the gripping structures, preferably at least the first and/or second inner gripping surfaces, may comprise a rough and/or textured surface, e.g. corrugated, dimpled, knurled etc., and/or may comprise a material that is soft and/or having an elevated friction against human skin, e.g. rubber, silicone rubber, neoprene, or other "non-slip" material. This increases a secure grip on the tray.

If the tray has a circular outer shape, in axial view, the center of gravity, the axis and the proper balance are readily recognizable, which facilitates stable carrying and balanced loading of the tray. An upstanding rim surrounding the top side prevents slipping and/or leaking from objects and/or liquids on the tray. At least part of the top side of the tray may further be provided with a non-slip and/or liquid-absorbent surface.

BRIEF DESCRIPTION OF THE DRAWINGS

The above-described aspects will hereafter be more explained with further details and benefits with reference to the drawings showing embodiments of the invention by way of example.

FIG. 1 is a perspective bottom view of a serving tray as provided herein;

FIG. 2 is a bottom view of the tray of FIG. 1;

FIG. 3 is a side view of the tray;

FIG. 4 shows a mid-plane cross section of the tray as indicated in FIG. 2 at VI-VI;

FIG. 5 shows detail V of FIG. 4;

FIGS. 11 and 12 indicate a posture difference between use of a traditional tray and of the presently provided tray;

DETAILED DESCRIPTION OF EMBODIMENTS

Figure 6:
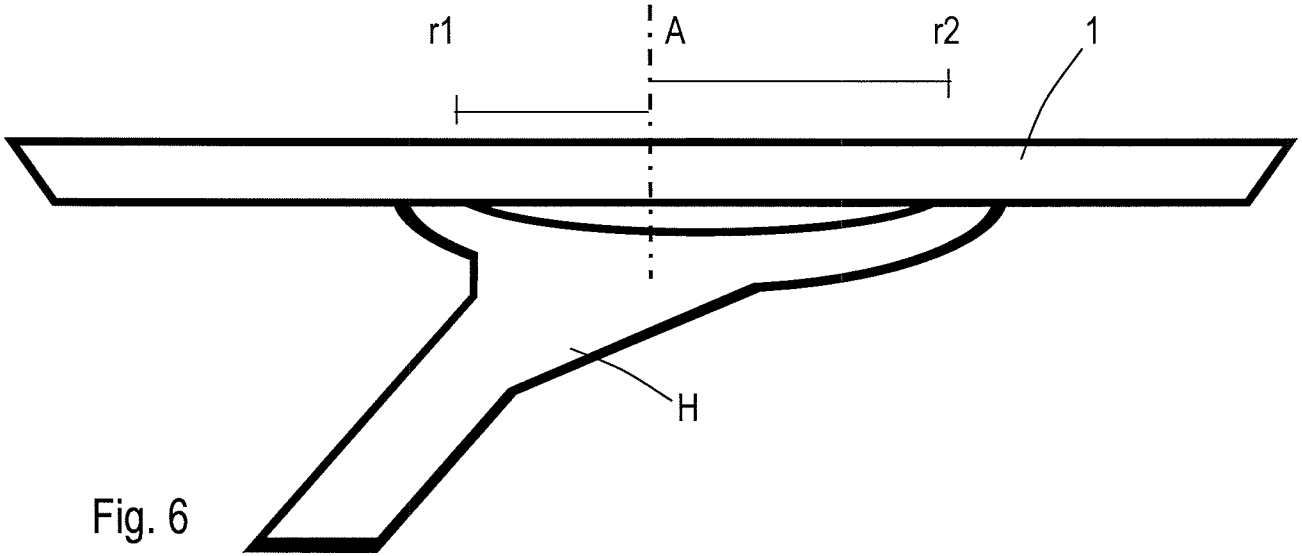
FIG. 6 indicates a method of use of the tray.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral.

FIGS. 1-4 show a serving tray 1 having a body 2 with a top side 3, a bottom side 5, and an upstanding rim 7 protruding from (the top side 3 of) the body 2 and surrounding the tray 1. The tray 1 has a circular outer shape. In the shown preferred embodiment the tray 1 is generally symmetric about the origin of the circular outer shape and it is so balanced that its center of gravity is in the center of the tray 1 and an axis A extending through the center of gravity substantially perpendicular to the top and bottom sides extends through the origin of the circular outer shape.

In the following, all directions are referred to in standard cylindrical coordinates with respect to the axis A.

The tray 1 has a relief comprising two gripping structures 9, 11 formed as recesses 9, 11 in the bottom side 5 into the body 2. Here, the gripping structures 9, 11 are configured as rings, being symmetrically arranged in concentric circular shape about the axis A and providing a central portion 13 radially inside of the first gripping structures 9, a middle portion 15 between the first and second gripping structures 9, 11 and an outer portion 17 radially outward of the second gripping structure 11. The gripping structures 9, 11 are arranged for receiving part of the fingertips of a user, typically the thumb in the first gripping structure 9 and at least some other fingertips in the second gripping structure 11, as schematically indicated with tray 1 and hand H in FIG. 6.

Best seen in FIGS. 4 and 5, the top side 3 and bottom side 5 are generally planar, apart from the recessed gripping structures 9, 11. The gripping structures 9, 11 each have, in radial cross section, a radially inner first and second gripping surface 9A, 11A, respectively, provided by a wall with a slope into the body 2 that is relatively steep with respect to the radial direction, being generally perpendicular to the bottom side 5, here apart from a small-radius chamfer. The inner gripping surfaces 9A, 11A, are arranged at first and second radial positions r1 and r2, respectively. The gripping structures 9, 11 further each comprise a top surface 9B, 11B which in this embodiment have a radially outward slope relative to the axial direction that is quite small but distinct from being parallel to the bottom side 5. Here, the top surfaces 9B, 11B are also curved. Due to the circular shape of the first and second gripping structures 9, 11 about the axis A, the top surfaces 9B, 11B are generally conical about the axis A with the top angle in upward direction. The top surfaces 9B, 11B are provided with a relief structured to increase friction against human skin, e.g. having an embossed rectangular or honeycomb grid or leather-look print.

In use, the fingers of a user's carrying hand will naturally find the gripping features 9, 11 and assume an optimum position underneath the tray 1 wherein the central portion 13 and the center of gravity of the tray 1 are arranged over or on the palm of the hand, without the user requiring to 'test' the balance of the tray and accuracy and security of his/her hold on the tray 1. Thus, the tray 1 can easily be carried in balanced fashion and any unbalance due to uneven loading of the tray 1 can be readily corrected, assisted by the relief of the gripping structure surfaces.

Figure 7:
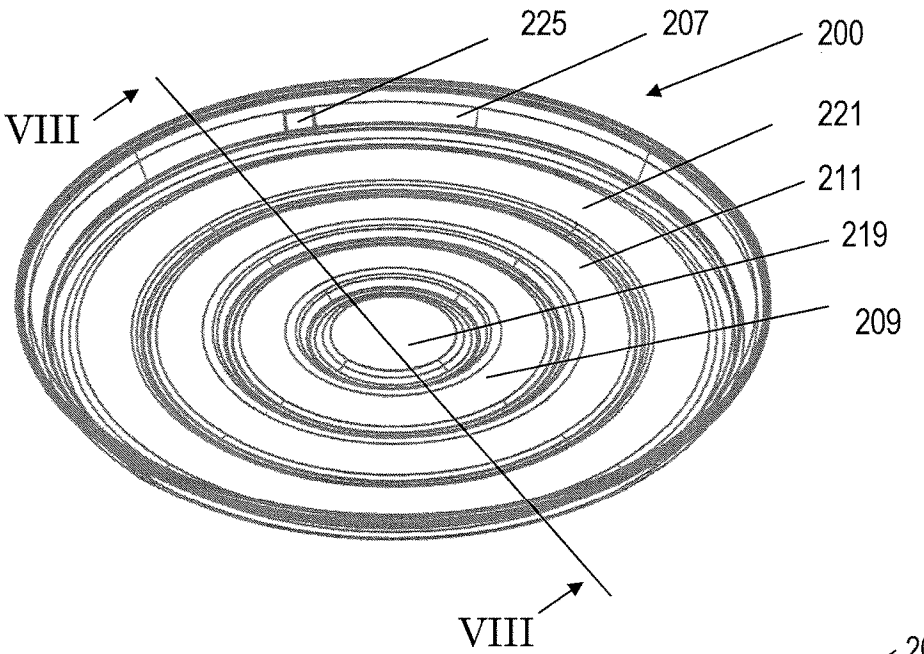
FIG. 7 is a perspective bottom view of another embodiment of a serving tray.
Figure 8:
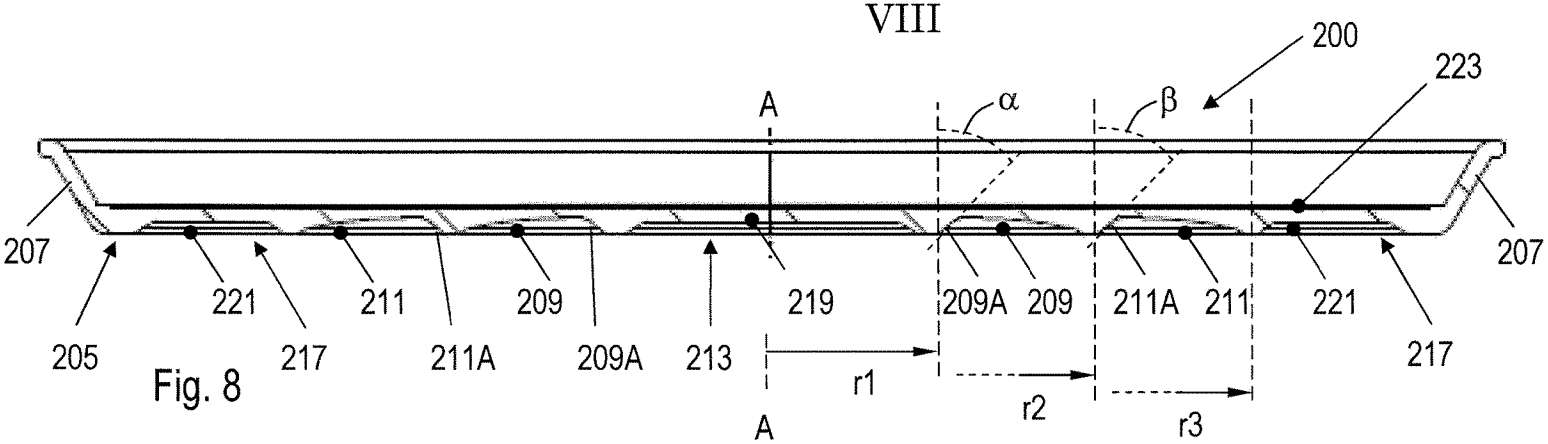
FIG. 8 shows, like FIG. 4, a mid-plane cross section of the tray of FIG. 7.

FIGS. 7-8 show another embodiment 200 in bottom perspective and mid-plane cross section, respectively. The serving tray 200 is generally similar to the serving tray 1 of FIGS. 1-5. As a difference, in the bottom side 205, first and second further recessed portions 219, 221, are provided in the central portion 213 radially inside of the first gripping portion 209 and in the outer portion 217 radially outside of the second gripping portion 211. Here, the first and second further recessed portions 219, 221 extend fully around the axis A and are circular, conforming to the shapes of the first and second gripping structures 209, 211. Thus, the outer portion 217, is substantially formed as the further recess 221 and an outer rim 223, which here extends continuously and circularly around the bottom of the tray 200. Except for the recessed portions and structures 219, 209, 211, 221, the bottom side 205 of the tray 200 is planar.

It is noted that differently shaped further recesses may be provided, e.g. providing a plurality of relatively small-sized recesses in the inner and outer portions 213, 217, possibly formed as dents, concentric rings, circle segments and/or other shapes like triangles, stars etc.

In the top surface 3 an optional recess 223 is provided which may receive at least part of a lining or cover, e.g. comprising a liquid absorbent and/or anti-slip-material, which may carry advertisement indicia. The recess 223 may have any suitable size and/or shape.

On the upstanding rim 207, here on the outside thereof, an optional stacking abutment, e.g. a protrusion 225 as shown here, may be provided which facilitates stable stacking of trays and prevents sticking together of stacked wet trays.

Figure 9:
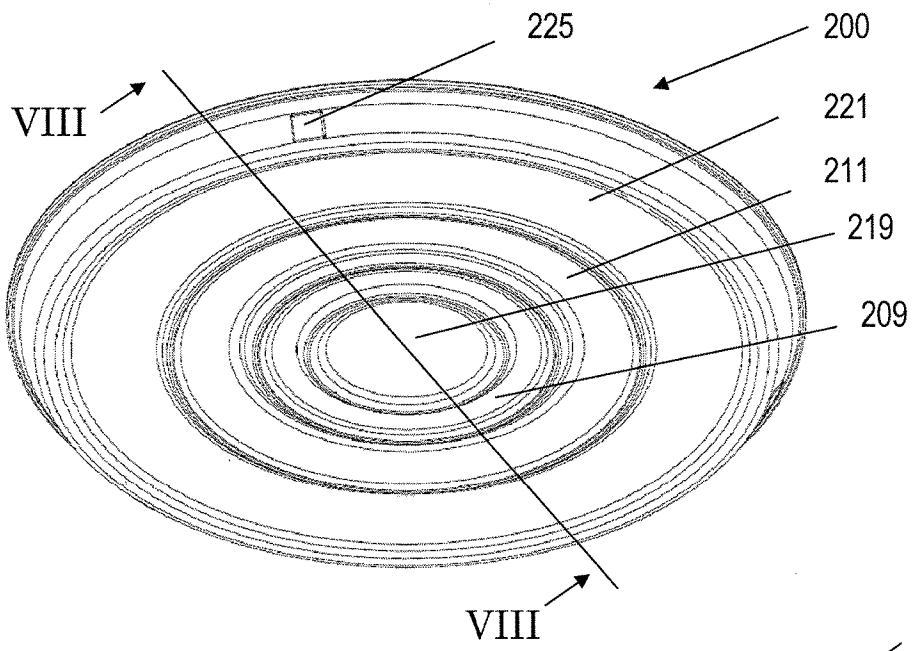
FIGS. 9 and 10 show, like FIGS. 7-8, a further embodiment of a tray
Figure 10:
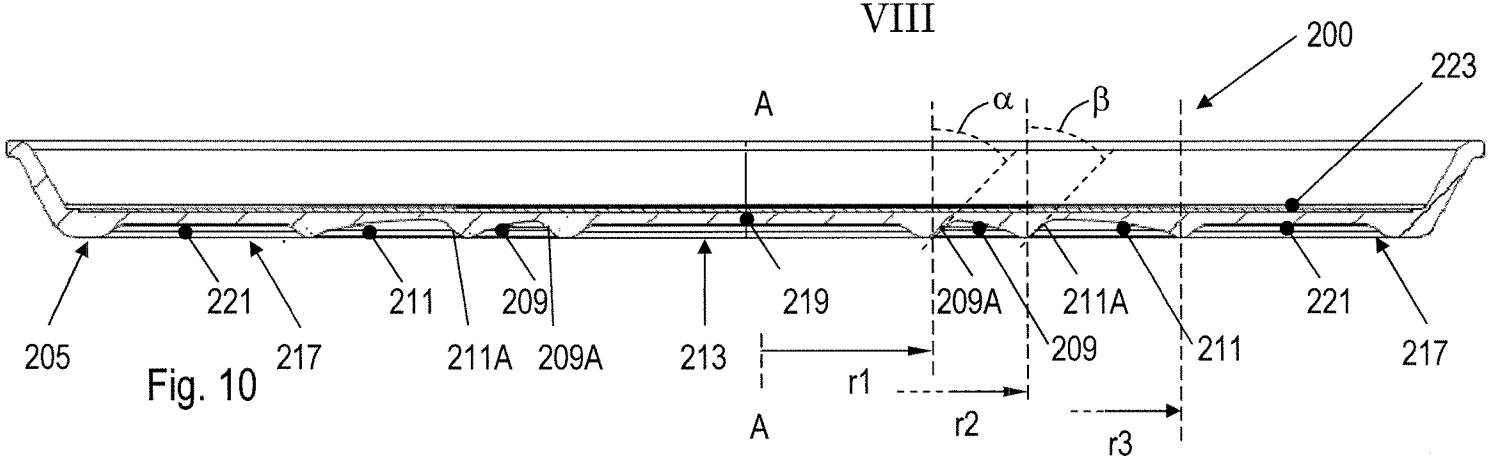

FIGS. 9-10 show another embodiment of a tray, largely similar to the tray of FIGS. 7-8 but having different dimensions and a different aspect ratio between (the radii r1, r2 of) the gripping portions 209, 211 and the overall size of the tray.

The recessed nature of the gripping structures 9, 11 in an otherwise planar bottom side facilitates sliding the tray 1 on or off a surface, wherein the user's hand naturally will feel and hold the gripping structures 9, 11, without requiring (time for) testing and checking the appropriate balance of the tray 1. The ergonomic shape reduces strain on and fatigue of the user's hand and reduces chances of tipping the tray and/or spilling carried objects, e.g. drinks. Also, the presently provided tray is thought to improve the user's sense of security and wellbeing, and thus improves the user's job satisfaction.

In a preferred embodiment, the first gripping surface 9A is arranged at a radial position r1 of about 4-5 cm, preferably about 4.3-4.6 cm, e.g. at a radius of about 4.4 cm (=a diameter of ca 8.8 cm), and the second gripping surface is arranged at a radial position r2 of about 6-8 cm, preferably about 6.5-7 cm, e.g. at a radius of about 6.7 cm (=a diameter of ca 13.4 cm). The second gripping portion preferably extends to a radius r3 of about 8-13 cm, more preferably about 9-11 cm, e.g. at a radius of about 10.5 cm (=a diameter of about 21 cm). It is found that such values tend to fit for most adult hands for providing a reliable grip suitable for serving trays up to about 40 cm diameter, although larger or smaller trays e.g. 20-50 cm diameter may be provided as well.

In a preferred embodiment, the first and/or second gripping structures are recessed for about 2-5 mm, e.g. 2-4 mm, e.g. about 2.5-3 mm. It is found that such depths, in particular when provided with a rough and/or textured surface, suffice to receive a sufficient portion of a finger tip that a reliable grip can be exerted on the tray. As a result, the tray need not have a particularly thick bottom and therefore may remain quite light weight.

It is noted that the recessed nature of the gripping structure of the presently provided tray reduces the tray's weight. For example, suitable approximate values for the serving tray shown in FIGS. 1-5 are: circular tray of 40.5 cm diameter, base thickness 6 mm, rim height 23 mm, width of first gripping structure 2 cm extending between 45 mm and 65 mm radius, width of second gripping structure 3.5 cm extending between 68 mm and 103 mm radius, depth of first and second gripping structures 2.5 mm, weight 650-800 gram, depending on the material. The upstanding rim may have another thickness than the base. The strength and weight range of such serving tray are equal to those of customary professional bar and restaurant plastic serving trays of 40.5 cm diameter and 4 mm base thickness. Other typical values are: radial position r1 of first gripping surface ca. 44 mm, radial position r2 of second gripping surface ca. 67 mm, depth of first and second gripping structures 3 mm (=height of gripping surfaces).

In a preferred embodiment, at least one of the first and second radially inner gripping surfaces 9A, 11A, preferably both, has a radially inner slope that extends in an angle $\alpha$, $\beta$ with respect to the radial direction about the axis A in a range of 10-60 degrees, in particular 30-50 degrees, i.e. in a range of 80-30 degrees, in particular 60-30 degrees, with respect to the axial direction (see FIG. 8). The angles $\alpha$, $\beta$ need not be equal. It has been found that such angles provide excellent grip and, more importantly, conform to the naturally stretched/extended position of the fingers of a hand. Thus, overstretching digits as in prior art trays and depicted in FIG. 11 (see the arrows) is prevented and the fingers may assume a straight posture as indicated in FIG. 12. As a consequence, the weight of the tray 1 with any load thereon and associated carrying forces are transferred along the length of (the bones of) the user's fingers to the stronger musculature of the hand palm, the wrist and the arm of the user, instead of having to be supplied (mainly) by the more delicate and generally weaker finger muscles, being overstretched and thus weakened at that.

Figure 13:
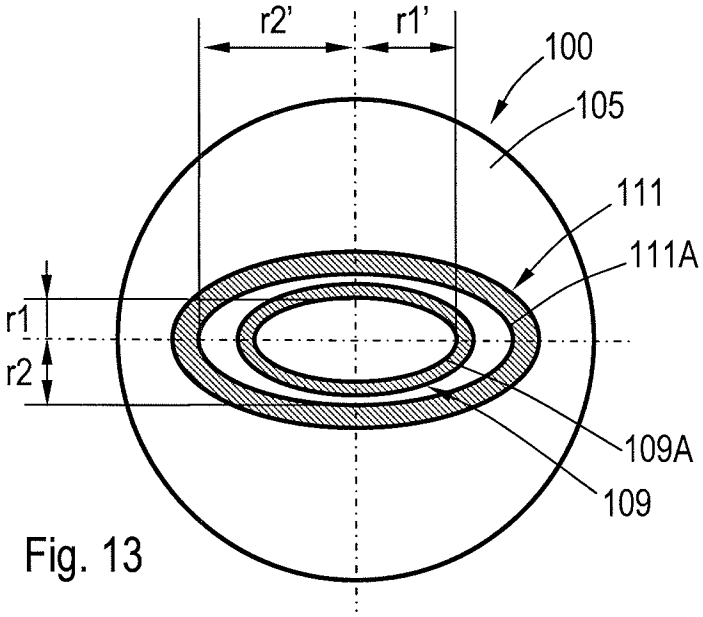
FIG. 13 is a schematic bottom view of an alternative embodiment of a tray.

FIG. 13 shows a serving tray 100 generally similar to that of FIGS. 1-10, but here the first and second gripping structures 109, 111 are generally concentric elliptic rings, rather than circular. As shown, as long as the ratio R of the local radial position of the respective first gripping surface r1, r1' and the local radial position of the diametrically opposite respective second gripping surface r2, r2' is generally constant, such tray 100 also provides a centralised grip with constant balance of the tray with respect to the gripping features 109, 111, but the absolute distances between the first and second gripping structures 109, 111, varies with the rotational orientation of the tray. Thus, the tray 100 may be rotated to fit different hand sizes, while providing constant position of the center of gravity, so that such rotational size-adjustment can be done without jeopardising the balance and/or stability of the tray and supported goods. In such tray, the outer shape of the tray and the geometry of the first and second gripping structures may correspond, e.g. leading to an elliptical serving tray. Asymmetric shaped gripping structures, e.g. oval or other may also be provided, in which case the first and second gripping structures should be arranged mirror-inverted about the axis A to maintain a constant ratio R of the radial positions of the respective opposite gripping surface portions.

The present disclosure is not restricted to the above described embodiments which can be varied in a number of ways within the scope of the appended claims. For instance the gripping structures and the tray may have other relative dimensions. The tray need not be round. Further, the gripping structures need not be constant and may be interrupted. A relief of the gripping structure surfaces may comprise concentric circles about the tray's axis A. Further, opposite to the shown embodiments, the first and/or second gripping surface may be at least partly recessed or hollowed inward in radial direction (having a sand-hour-like shape along the axial direction), providing a waisted central portion and a relatively sharp, somewhat radially outward extending lower, edge to serve as a ledge for increased finger retention. The first and second gripping structures may have different depths, surface structures and/or surface materials.

Elements and aspects discussed for or in relation with a particular embodiment may be suitably combined with elements and aspects of other embodiments, unless explicitly stated otherwise.

The invention claimed is:

1. A serving tray for carrying a plurality of drinks, comprising a top side, a bottom side, and a periphery, wherein the top and bottom sides are generally parallel to each other, the top side being planar so as to support the plurality of drinks on the tray and the bottom side being arranged to carry the tray by hand, an upstanding rim surrounding the top side and protruding therefrom on a periphery of the tray, wherein the tray has a center of gravity and an axis extending through the center of gravity substantially perpendicular to the top and bottom sides, wherein the bottom side has a relief comprising first and second gripping structures each generally surrounding the axis, the first gripping structure being recessed and providing a first radially inner gripping surface, and the second gripping structure being recessed and providing a second radially inner gripping surface, and wherein the first and second gripping structures are configured as concentric rings such that sections of the first and second inner gripping surfaces are located diametrically opposite each other at first and second radial distances with respect to the axis, respectively, wherein at least one of the first gripping structure and the second gripping structure has an inner gripping surface having a radial inner slope that extends from the bottom side away from the axis, and a gripping structure top surface, further from the axis than the inner gripping surface, having a radial outer slope that extends in a slope away from the inner gripping surface toward the bottom side, and such that in plural azimuthal positions around the axis, the ratios of the first and second radial distances of the respective opposite sections are equal.

2. The serving tray according to claim 1, wherein the ratios are constant around the axis.

3. The serving tray according to claim 1, wherein the first and second inner gripping surfaces are substantially continuous around the axis (A).

4. The serving tray according to claim 1, wherein at least the first and second inner gripping surfaces are circular.

5. The serving tray according to claim 1, wherein the bottom side is, apart from the recessed gripping structures, substantially planar.

6. The serving tray according to claim 1, wherein the bottom side radially inside the first gripping structure and/or radially outside of the second gripping structure, comprises one or more further recessed portions.

7. The serving tray according to claim 1, wherein at least part of the gripping structures comprises a rough and/or textured surface.

8. The serving tray according to claim 1, wherein at least part of the gripping structures comprises a material that is soft and/or having an elevated friction against human skin.

9. The serving tray according to claim 1, wherein at least a section of the first gripping structure is arranged at a radial position with respect to the axis in a range of about 4-5 cm.

10. The serving tray according to claim 9, wherein and at least a section of the second gripping structure is arranged at a radial position of about 6-8 cm.

11. The serving tray according to claim 10, wherein at least a section of the first gripping structure is arranged at a radial position with respect to the axis in a range of about 4.3-4.6 cm.

12. The serving tray according to claim 11, wherein and at least a section of the second gripping structure is arranged at a radial position of about 6.5-7 cm.

13. The serving tray according to claim 1, wherein at least one of the first and second gripping structures are recessed for about 2-5 mm.

14. The serving tray according to claim 1, wherein at least one of the first and second radially inner gripping surfaces has a radially inner slope that extends in an angle in a range of 10-60 degrees with respect to a radial direction about the axis.

15. The serving tray according to claim 14, wherein at least one of the first and second radially inner gripping surfaces has a radially inner slope that extends in an angle in a range of 30-50 degrees with respect to a radial direction about the axis.

16. The serving tray according to claim 1, wherein at least one of the first and second gripping structures are recessed for about 2-3 mm.

17. The serving tray according to claim 1, wherein the upstanding rim and the top side are symmetric about the axis.

18. A serving tray for carrying a plurality of drinks, comprising a top side, a bottom side, and a periphery, wherein the top and bottom sides are generally parallel to each other, the top side being planar so as to support the plurality of drinks on the tray and the bottom side being arranged to carry the tray by hand, wherein the tray has a center of gravity and an axis extending through the center of gravity substantially perpendicular to the top and bottom sides, wherein the bottom side has a relief comprising first and second gripping structures each generally surrounding the axis, the first gripping structure being recessed and providing a first radially inner gripping surface, and the second gripping structure being recessed and providing a second radially inner gripping surface, wherein the first and second gripping structures are configured as concentric rings such that sections of the first and second inner gripping surfaces are located diametrically opposite each other at first and second radial distances with respect to the axis, respectively, and such that in plural azimuthal positions around the axis, the ratios of the first and second radial distances of the respective opposite sections are equal; and wherein at least one of the first and second gripping structures is asymmetric in radial cross section, having first and/or second inner gripping surfaces with a radially inner slope that is relatively steep and extends in a slope from the bottom side away from the axis, and a gripping structure top surface, further from the axis than the inner gripping surface, having a radially outer outward slope that is relatively small and extends away from the inner gripping surface in a slope toward the bottom side.

19. The serving tray according to claim 18, wherein the gripping structure top surface is curved and/or generally conical about the axis with a top angle in an upward direction.

20. A serving tray for carrying drinks, comprising a top side, a bottom side, and a periphery, wherein the top and bottom sides are generally parallel to each other, the top side being planar and arranged for supporting one or more drinks on the tray and the bottom side being arranged to carry the tray by hand, wherein the tray has a center of gravity and an axis extending through the center of gravity substantially perpendicular to the top and bottom sides, wherein the bottom side has a relief comprising first and second gripping structures formed as recesses in the bottom side, each generally surrounding the axis, the first gripping structure being recessed and providing a first radially inner gripping surface, and the second gripping structure being recessed and providing a second radially inner gripping surface, wherein the first and second gripping structures are configured as concentric rings such that sections of the first and second inner gripping surfaces are located diametrically opposite each other at first and second radial distances with respect to the axis, respectively, and such that in plural azimuthal positions around the axis, the ratios of the first and second radial distances of the respective opposite sections are equal; and wherein the first and second gripping structures each are asymmetric in radial cross section, having first and, respectively, second inner gripping surfaces with a radially inner slope that is relatively steep and extends in a slope from the bottom side away from the axis, and a gripping structure top surface further from the axis than the inner gripping surface and having a radially outer outward slope that is relatively small but distinct from being parallel to the bottom side, and extends away from the inner gripping surface in a slope toward the bottom side.

* * * * *